US005184101A

United States Patent [19]

Ineichen et al.

[11] Patent Number: 5,184,101

[45] Date of Patent: Feb. 2, 1993

[54] UNDERVOLTAGE TRIPPING DEVICE

[75] Inventors: Kurt Ineichen, Emmenbrücke; Peter Rüedi, Neuenkirch; Herbert Wirth, Gisikon, all of Switzerland

[73] Assignee: Weber AG, Emmenbrucke, Switzerland

[21] Appl. No.: 704,336

[22] Filed: May 23, 1991

[30] Foreign Application Priority Data

May 23, 1990 [CH] Switzerland ..... 1774/90

[51] Int. Cl.[5] ..... H01H 51/22

[52] U.S. Cl. ..... 335/78; 335/128

[58] Field of Search ..... 335/78-86, 335/121, 124, 128, 131-133

[56] References Cited

U.S. PATENT DOCUMENTS 3,708,723 1/1973 Shand et al. ..... 335/182
4,231,007 10/1980 Tanaka et al. ..... 335/131
4,544,987 10/1985 Loring ..... 361/194

*Primary Examiner*—Lincoln Donovan
*Attorney, Agent, or Firm*—Tarolli, Sundheim & Covell

[57] ABSTRACT

The undervoltage tripping device has an electromagnet with a magnet winding (3), a core (10) and an armature (20) and a tripping member (50) able to perform a tripping movement. In the ready-to-trip state the armature is in an attracted position on the core, is spring loaded in the dropping direction, but is prevented from dropping from the core by the magnetic force of attraction produced by the electromagnet. The tripping member is also spring loaded in this state, but is prevented from performing the tripping movement by the attracted armature. The electromagnet is a d.c. magnet. A rectifier is provided for rectifying the current flowing through magnet winding. Mechanical aids are provided for feeding the armature into the attracted position. The tripping member is latched in self-release manner in the ready-to-trip state. The latching effect is released when the armature drops.

12 Claims, 3 Drawing Sheets

UNDERVOLTAGE TRIPPING DEVICE

TECHNICAL FIELD

The invention relates to an undervoltage tripping device for an appliance protective switch in accordance with the preamble of claim 1.

PRIOR ART

Tripping devices of this type are used in conjunction with protective switches for electrical appliances, which have electromotively driven parts. Their function is then, in the case of a failure (or dropping below a minimum value) on the part of the operating voltage to trip the protective switch and prevent the appliance motor from automatically restarting when the power returns. It must only be possible to switch on the appliance by again manually operating the protective switch.

It is important here to distinguish between the aforementioned appliance protective switches and so-called motor protective switches. Whereas the former are essentially intended for installation in electromotively driven hand-operated equipment, the latter are mainly intended for the protection of more powerful fixed-installed machines. Due to the normal size of elecrical hand-operated appliances appliance protective switches must have a very compact construction and due to the relatively low price thereof must be as simple and inexpensive as possible. The size and price of the appliance protective switch must be in a sensible ratio to the size and price of the electrical appliance to be protected. The size and simple construction requirements do not exist to the same extent in the case of motor protective switches. In connection therewith greater importance is attached to requirements concerning sensitivity, switching precision, breaking capacity, etc. The generally higher price of fixed-installed machines also allows a more complicated construction of the protective switch. Thus, relatively complicated locking devices are frequently encountered in motor protective switches. As a result of the above differences, appliance protective switches and motor protective switches are e.g. separately dealt with in standards.

In connection with the undervoltage tripping devices for appliance protective switches on the one hand and for motor protective switches on the other, the aforementioned differences again apply in principle. As a result of the very simple tripping mechanisms of appliance protective switches higher demands must be made on the purely mechanical tripping force or the available mechanical work function of undervoltage tripping devices for appliance protective switches than for the undervoltage tripping devices for motor protective switches with the more complicated, more easily trippable locking devices. In addition, increased account must be taken of the dirtying or contamination problem in the case of undervoltage tripping devices for appliance protective switches, because, as a result of the very point of installation, the possibilities of preventing dirtying from the outset are more limited than in the case of undervoltage tripping devices for motor protective switches.

If, as is normally the case, alternating current magnets are used the problem of disturbing alternating current hum occurs with both undervoltage tripping devices. An attempt is made to counteract this by a complicated machining of the pole faces on the core and armature. However, excessively smooth pole faces suffer from the disadvantage that the core and armatures still adhere to one another when the magnetic force of attraction between them has ceased in the case of undervoltage. Hum is particularly pronounced when the pole faces are dirty. As stated hereinbefore contamination is more likely in the case of undervoltage tripping devices for appliance protective switches.

To produce the magnetic holding force for the armature during the troublefree time an electric continuous power output must be applied to the electromagnet winding and this is made noticeable by through dissipated heat. It is obvious that this dissipated power must be kept as small as possible. However, limits are placed on the dissipated power reduction in that the magnetic holding force must at least be sufficiently high to be able to compensate the spring loading of the armature in the ready-to-trip state in the decreasing direction. In the case of an undervoltage tripping device, such as that known from German Utility Model 78 00 032, the armature is one of the two arms of an angle lever, whose other arm is loaded by a tripping member loaded by a tripping spring in the ready-to-trip state. Thus, here the magnetic holding force must compensate the tripping force of the tripping spring increased in accordance with the leverage. Obviously, through a corresponding dimensioning of the lever transmission ratio it is possible to reduce the necessary magnetic force of attraction and consequently the dissipated power. However, disadvantageously, as the transmission increases, the working path of the tripping member decreases.

DESCRIPTION OF THE INVENTION

On the basis of what has been stated hereinbefore, the problem of the invention is to provide an undervoltage tripping device for an appliance protective switch, in which there is only a small dissipated power, but which still has an adequately high tripping force with an adequately large tripping path of the tripping member for tripping even difficultly trippable appliance protective switches, which is substantially insensitive to dirtying or contamination, in which hum is avoided and which is easy and inexpensive to manufacture.

These and further problems are inventively solved by an undervoltage tripping device with the features of claim 1.

The inventive tripping device is firstly characterized in that the electromagnet is a direct current magnet and that a rectifier is provided for rectifying the current flowing through the magnet winding. The use of a direct current magnet in place of the usual alternating current magnet solves the unpleasant hum problem. It is possible to construct d.c. magnets with fewer components and therefore more simply than a.c. magnets. There is no need for a complicated maching or treatment of the pole faces for reducing hum. There are no magnetic losses in the core and armature.

The costs for the additionally necessary rectifier is nore than compensated by the simpler construction and the expense saved through avoiding hum.

In addition, according to the invention mechanical aids are provided for bringing the armature into the attracted position. This is associated with the advantage that the electromagnet need only be sufficiently powerful to keep the armature in the attracted position in opposition to the drawing-off force acting thereon. There is no need to also apply the force for attracting the armature in said position counter to the action of the drawing-off force. This feature also contributes to a more compact and less powerful electromagnet design.

Finally, according to the invention, in the ready-to-trip state the tripping member is latched in in self-releasing manner and self-release occurs when the armature drops. Thus, the drawing-off force acting on the armature in the ready-to-trip state need only be part of the total spring loading acting on the tripping member, but without this having any disadvantageous effect on the tripping path of the tripping member.

Advantageous developments of the inventive tripping device can be gathered from the dependent claims. Further developments can be gathered from the subsequently described embodiment with reference to the attached drawings.

BRIEF DESCRIPTION OF THE DRAWINGS

In the drawings show.

Coinciding parts are given the same reference numerals in the drawings.

WAYS FOR IMPLEMENTING THE INVENTION

Figure 2:
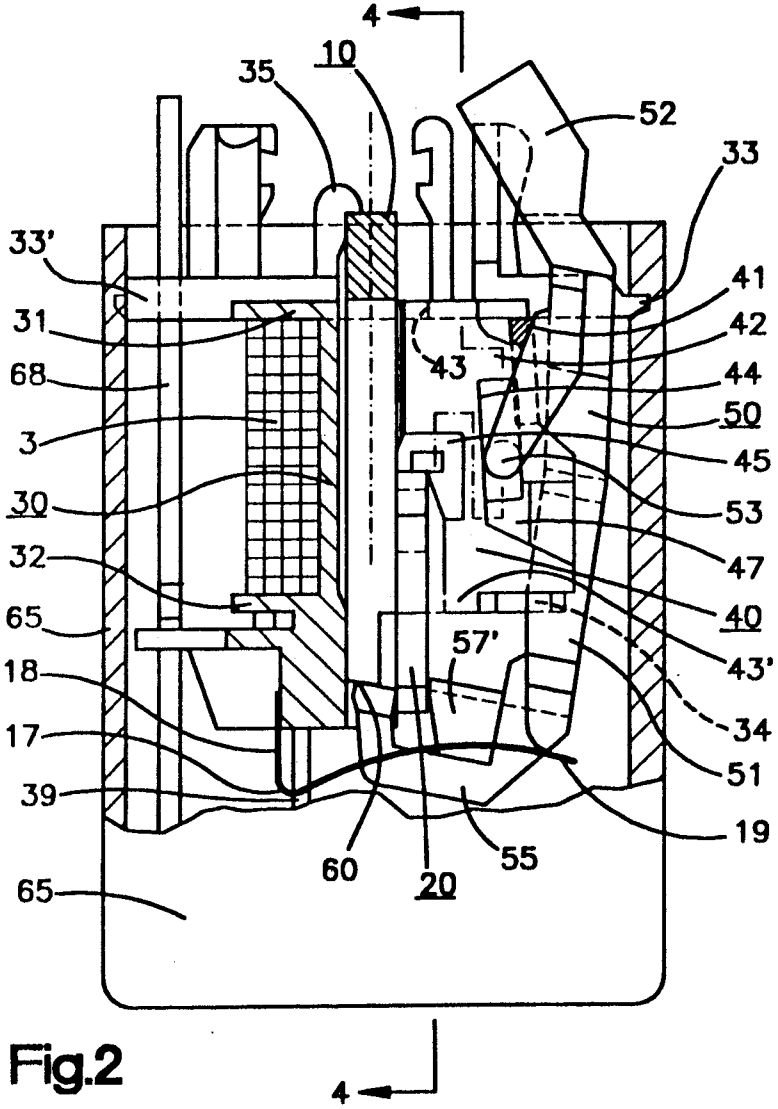
FIG. 2 The device of FIG. 1 in side view in the ready-to-trip state.

The undervoltage tripping device shown in FIGS. 1 to 5 has a direct current electromagnet with a magnet winding 3, a core 10 and an armature 20. A cup-shaped casing 65 receives these components. A circuit board 66 loaded with rectifier diode 67 is located in the bottom of the casing 65. On the basis of the a.c. voltage to be monitored and which is normally the mains a.c. voltage, said circuit components serve to produce the supply direct current for the magnet winding 3 of the electromagnet. At least in the case of mains a.c. voltage there are advantageously also series resistors for reducing the voltage and therefore the power consumption of the winding. Such series resistors are designated 69 in FIG. 5. Not shown Zener diodes can also be provided for reducing voltage peaks.

The voltage is supplied to the circuit board by two connecting rods 68 and two conductor pins 39 are used for the d.c. connection between the circuit board and the terminals of the magnet winding 3.

Figure 1:
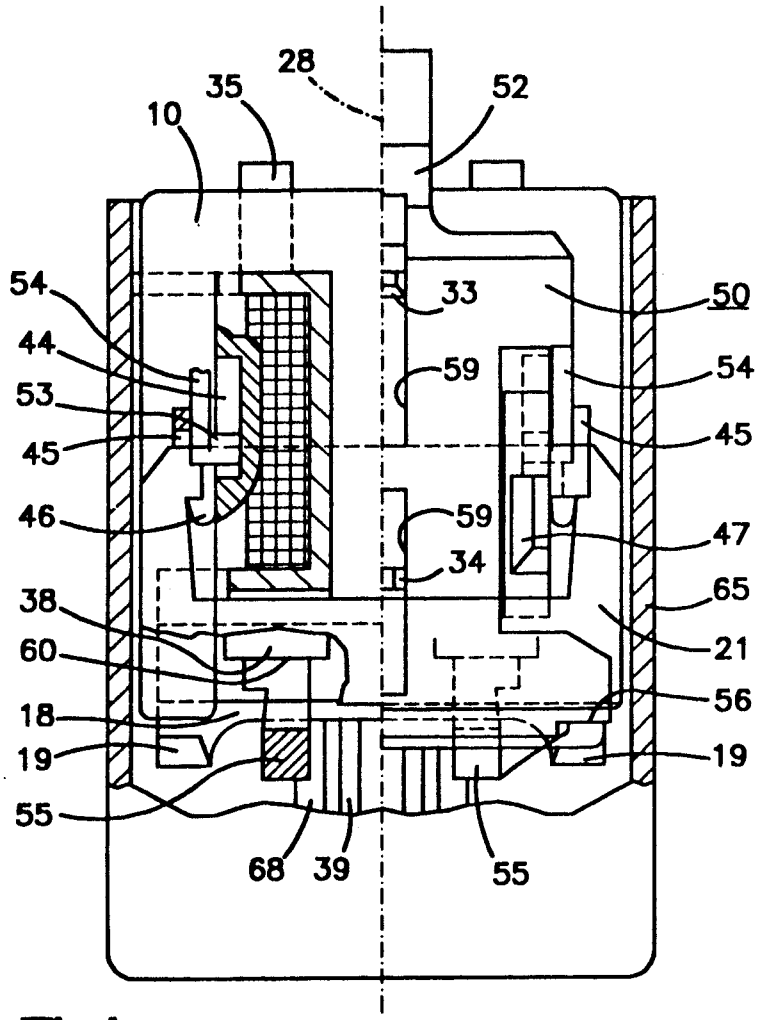
FIG. 1 An inventive undervoltage tripping device, namely in the right-hand part in elevation the broken-open casing and in the left-hand part in section along line IV—IV in FIG. 2.
Figure 3:
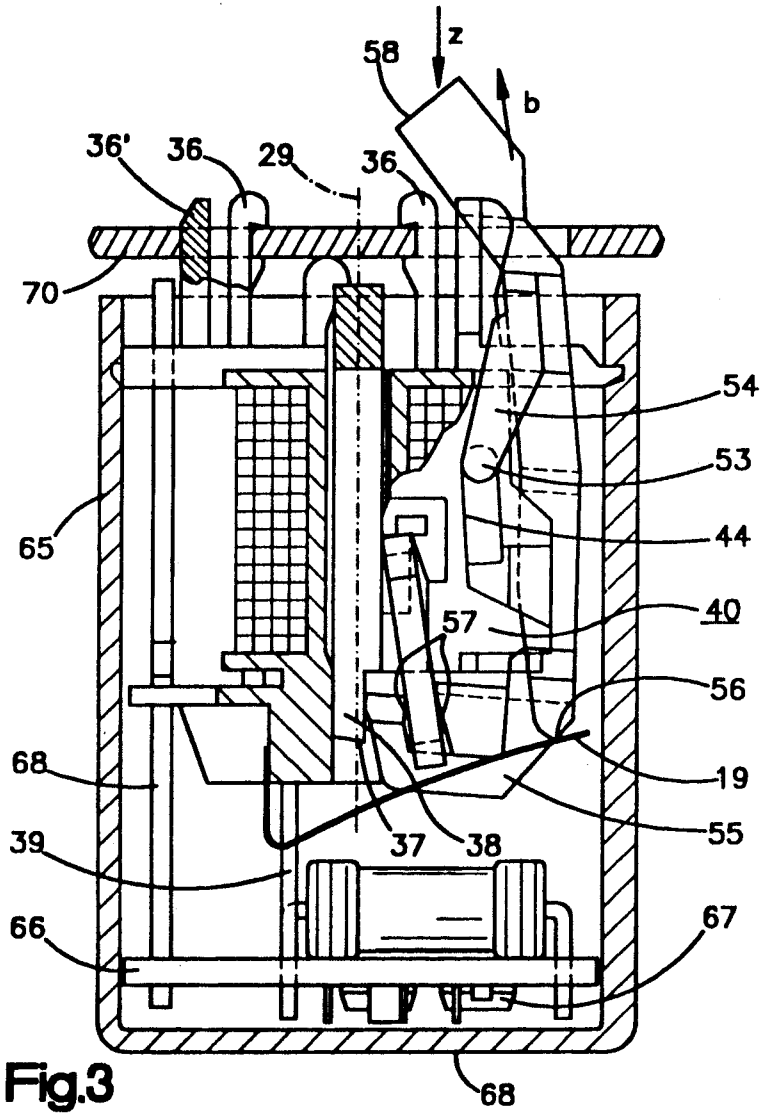
FIG. 3 A correspondig view of the device of FIG. 1 in the tripped state.
Figure 5:
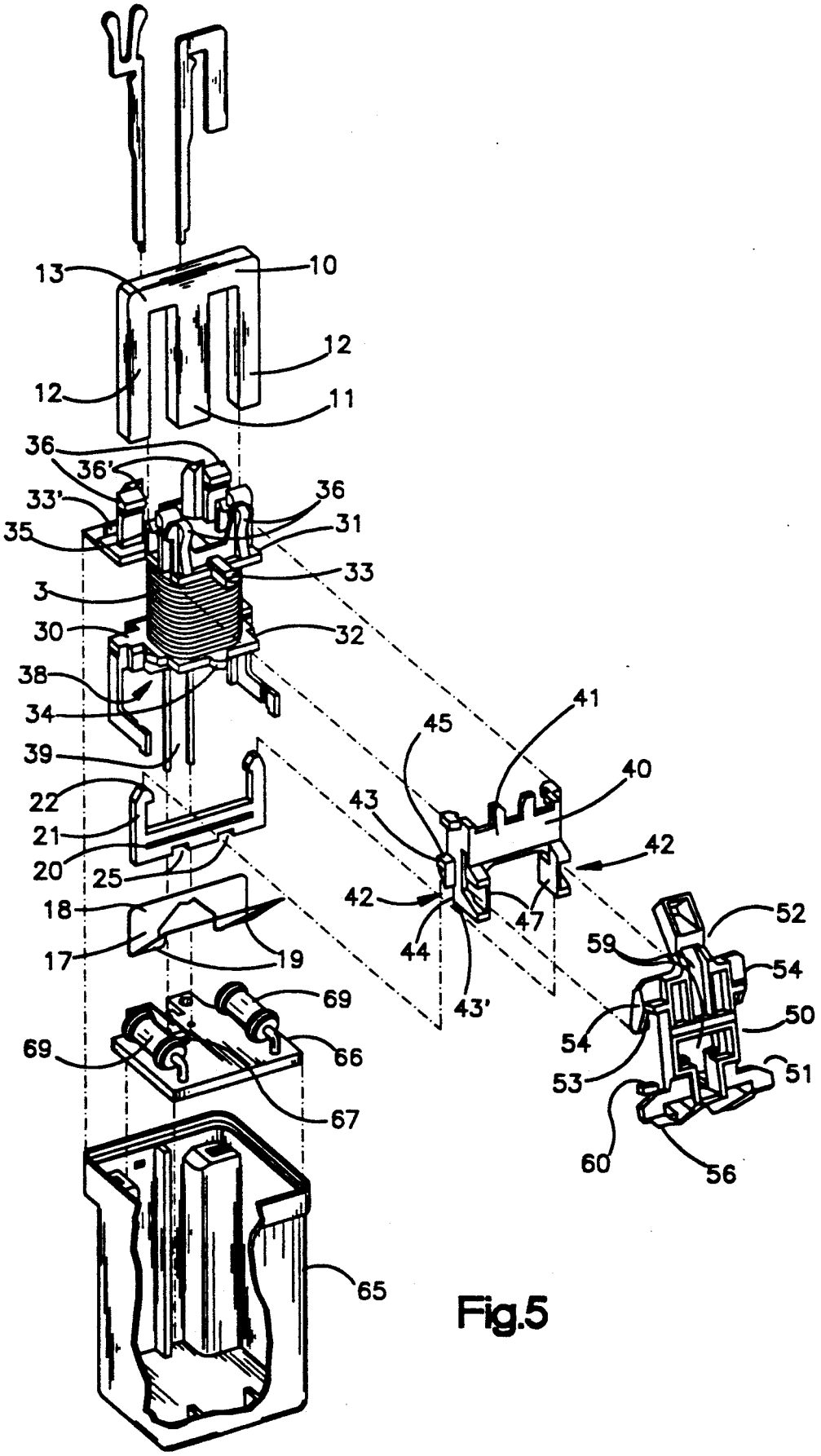
FIG. 5 A perspective exploded view of the complete tripping device.

With respect to the median plane 28 in FIG. 1, the tripping device has a symmetrical construction. The bearing or support part is constituted by a coil former 30, between whose upper flange 31 and a lower flange 32 is positioned the magnet winding 3 (upper, lower, vertical, etc. refer to the position of the device according to FIGS. 1 to 5). A cam 33 projects to one side from the edge of the upper flange 31 and two similar cams 33' projecting from the flange 31 are provided on the opposite side. The casing 65 is snapped onto the coil former 30 by means of these cams. Upwardly projecting snap-action hooks 36 and guide webs 36' adjacent thereto are shaped onto the top of the flange 31 (omitted in FIG. 1). They are used for the snap connection of the tripping device to a supporting part 70 of a protective switch cooperating with the device and as shown in FIG. 3.

The core 10 of the electromagnet is a flat E-core (FIG. 4), whose pole faces 14 are located on the flat side of the legs 11 and 12. The middle leg 11 of the core projects through a central longitudinal channel in the coil former 30, the free end projecting with the pole face over the lower flange 32. The two lateral legs 12 of the core are located outside the winding 3 and engage on the coil former facing their pole faces. The core 10 is secured in the coil former 30 by means of snap-action hooks 35, which are shaped on the upper flange 31 and engage over the yoke 13.

Figure 4:
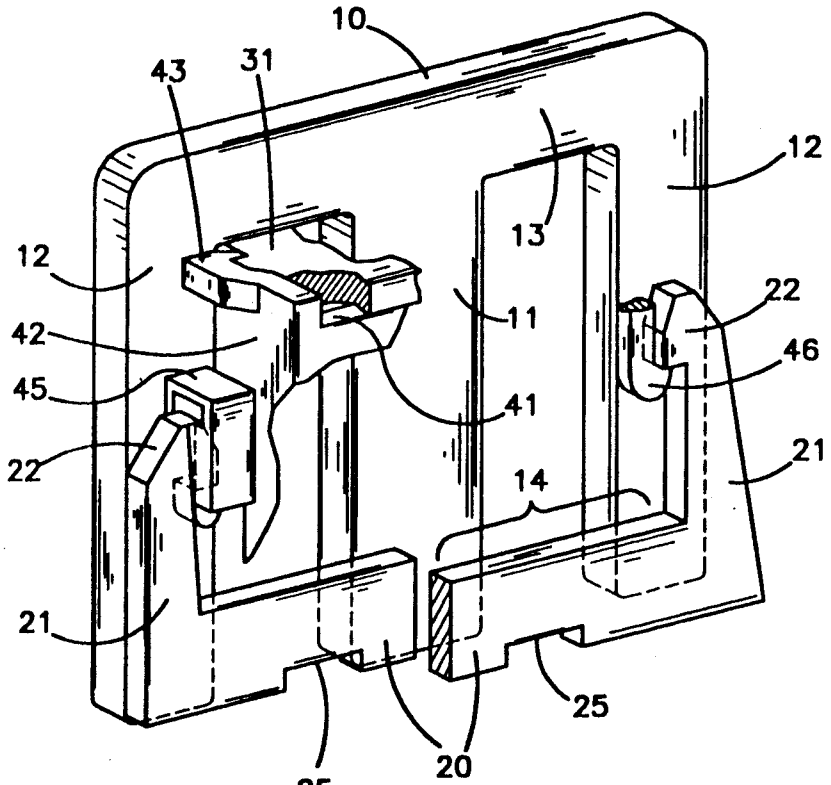
FIG. 4 A perspective view of the core and armature and other parts of the device according to FIGS. 1 to 3, the armature being shown attracted in the left-hand part and dropped in the right-hand part.

The armature 20 is a substantially U-shaped flat armature, whose U-legs 21, as shown in FIG. 4, engage on the flat sides of the outer legs 12 of the E-core 10. Between its attracted and its dropped position (left or right-hand halves of FIG. 7), the armature 20 performs a tilting movement about the hook-like ends 22 of its U-legs 21. The fastening and mounting of the armature 20 will be described hereinafter. The magnetic circuit could obviously also have a U-core in place of a three-legged E-core 10, the armature being appropriately modified. The described construction of the magnetic circuit with a flat core and flat armatures engaging on the flat sides of its legs makes it possible to manufacture these parts as inexpensive stamped parts from cold-rolled metal sheeting, no mechanical reworking of the pole faces being required. In addition, as a result the entire cross-sectional surface of the pole faces can be made larger than the total cross-sectional surface of the core legs, which has a favourable effect on the force of attraction in the case of any contamination of the pole faces.

An adaptor 40 engaging over the winding 3 is rigidly connected to the wound coil former 30. The adaptor 40 essentially has two parallel side walls 42 and a central wall 41 connecting them. It is located entirely on one side of the core 10 (right in FIGS. 2 and 3). The adaptor is laterally held on the coil former by means of a resilient snap connection produced by lateral moving up and at the top of each of the two side walls 42 a hook 43 engages behind a notch on the upper flange 31 (FIG. 4) and at the bottom a cam 43 snaps into a marginal notch on the lower flange 32. For guiding the subsequently described tripping member 50, the adaptor 40 is provided on each of its side walls with a guideway or guide link in the form of a groove 44 directed roughly axially of the electromagnet winding. In addition, a pivot bearing 45 for the armature is shaped onto each of the side walls 42. Each pivot bearing 45 engages with a flat side of an outer leg 12 and receives the end 22 of a U-leg 21. In addition, the hook-like ends 22 in each case guide behind a resilient snap-action hook 46, said hooks also being shaped onto the adaptor in the vicinity of the pivot bearing 45. Thus, the armature 20 is positioned with respect to the core pole faces 14. However, it is free for performing a tilting or pivoting movement between the attracted position (FIG. 2) and the dropped position (FIG. 3), the tilting or pivoting axis being determined by the guide for the leg ends 22 in the bearings 45.

The tripping member 50 is movably guided for performing a tripping movement b on the adaptor 40, is loaded by the tripping spring 17 and is in operative connection both with a latch 38 on the coil former and with the armature 20. The tripping member is constructed as a pivotably mounted, two-armed lever, with a latch-side (lower) lever arm 51 and an (upper) operating lever arm 52. The pivot bearing is formed by two pivots 53, each of which engages in one of the grooves 44 and is longitudinally guided therein. Each of the pivots 53 is located on a side arm 54, which projects from the operating lever arm 52 and engages over a side wall 42 of the adaptor. For inserting the pivot 53 in the guide grooves 44 during assembly, each adaptor side wall has a funnel-shaped recess 47, which issues from below into the groove, but has a depth which is smaller than that of the groove.

The tripping member 50 has two vertically directed, reciprocally aligned, through slots 59. Through the upper of the said slots projects the cam 33 emanating from the upper coil flange 31 and into the lower slot 59 projects a similar, but shorter cam 34, which projects from the lower coil flange 32. As a result of this guidance of the slots 59 on the cams 33 and 34 a "tilting" of the tripping member 50 (shown in FIG. 4) during its vertical sliding movements is prevented.

The latch-side lever arm 51 of the tripping member has two webs 55 projecting laterally against the coil former and with which it engages under the armature 20. Onto each of the upwardly bent ends of the webs 55 is shaped a sliding edge 60, which cooperates with the catch 38 located on either side of the centre leg 11 of the core, or the sliding face 37 thereof. The two portions of the latch 38 are shaped at the bottom on the coil former 30. It would also be conceivable to place the latch on the adaptor 40 locked with the coil former 30. However, it is advantageous to provide the latch with its sliding face on one of the said parts 30 or 40, which are produced as plastic injection mouldings, because it leads to a reduced, constant friction due to the high surface quality.

On both flat sides the armature 20 is guided between driving surfaces 57, which are located on the latch-side lever arm 51 and on the one hand on the ends of the webs 55 (in the vicinity of the sliding edge 60) and on the other hand on a cam 57' positioned between the two webs 55. On its lower edge the armature 20 has two recesses 25 into which engage with a certain clearance the webs 55 in the tripped, upper end position of the tripping member (FIG. 3).

The tripping spring 17 is shaped from a rectangular sheet metal blank with a window-like cutout. A vertical surface 18 is inserted from below in a slot on the coil former 30 and locked on the latter. Two spring legs 19 emanating from the surface 18 are bent to the side and engage in the vicinity of their ends on in each case one bearing edge 56, which at the bottom are positioned on the latch-side lever arm 51 of the tripping member. The tripping spring 17 in the form of a leaf spring loads with its legs 19 the tripping member 50 mainly in the vertically upwards direction.

The aforementioned device functions in the following way. After tripping has taken place (FIG. 3), the tripping member is in the upper end position, loaded by the partly relaxed spring 17 and with the pivots 53 abutting against the upper ends of the grooves 44. In order to then restore the ready-to-trip state (monitoring state) according to FIG. 2, an external feed force Z acting from above on the tripping member 50 is necessary. This force Z is applied by the switch coupled to the tripping device. A sloping surface 58 is provided for its action on the upper end of the operating lever arm 52. Whilst the feed force Z moves the tripping member downwards in the direction of the guide grooves 44 in opposition to the tripping spring 17, as a result of the sloping surface 58, a clockwise torque (visible in FIG. 3) about the pivots 53 acts on the tripping member. As a result of this torque, the latch-side lever arm 51 is forced to the left against the latch 38 and engages under the latter with its sliding edge 60 as soon as the latter passes beneath the sliding face 37. When the lever arm 51 moves to the left, the driving surface 57 on the cam 57' moves the armature 20 in the attraction direction and engages it laterally on the core 10. As a result the armature is forcibly mechanically delivered into the attracted position. The grooves 44 enable the pivots 53 or the entire tripping member to have a certain free downward path after engaging over the latch, so that the switch member exerting the feed force Z, does not abut against a hard stop and does not have to be sprung for this purpose. If the voltage to be monitored is present and consequently a current flows through the winding 3, the ready-to-trip state according to FIG. 2 is maintained, also when the feed force Z has been cancelled out. This state is characterized in that the tripping member 50 is latched with the latch 30 and engages with its edge 60 on the sliding face 37 of the latch. The latch 38 absorbs most of the spring loading of the tripping member emanating from the tensioned tripping spring 17, but as a result of the chosen orientation of the sliding face 37 a residual component of said spring loading remains through which the tripping member is forced to slide from the latch. This component is compensated by the magnetically attracted armature, which prevents the tripping member from sliding from the latch.

The device trips when the magnetic holding force on the armature 20 is eliminated. Under the action of the aforementioned residual component the tripping member slides with the edge 60 from the latch 38 and the armature is moved in the dropping direction by the webs 55 engaging over it. It is obvious that the residual component bringing about the release of the latching action must be sufficiently high in order to overcome the existing frictional resistances. The tripping movement of the tripping member until the latching action is released is mainly a pivoting movement and consequently mainly a translatory movement upwards in direction b, which is given by the guideway 44 and is substantially at right angles to the armature movement direction.

Therefore the latching is of a self-release nature and self-release is prevented by the armature in the ready-to-trip state. No active unlatching is required. As a result of the latching it is not necessary for the armature to compensate the complete tripping spring loading and instead only has to compensate a small part thereof, which is just sufficient to prevent the edge 60 from sliding from the latch 38 when the magnetic force is eliminated. The larger part of the tripping energy stored in the tension spring is available for most of the tripping movement of the tripping member after releasing the latching effect.

The tripping member 50 is approximately designed in such a way that its two lever arms 51, 52 are at least approximately balanced with respect to the pivot axis (pivots 53). As a result the tripping device is largely shock-proof, i.e. it is protected against false tripping in the case of an impact or blow.

The tripping device according to FIGS. 1 to 5 is more particularly designed for economic manufacture and assembly. The coil former 30, adaptor 40 and tripping member 50 are in the form of plastic injection mouldings. All the components are held together by snap-action connections. The parts are joined by linear joining movements in only two directions, namely on the one hand in the direction of the coil former axis 29 and on the other hand at right angles thereto. This permits an extensive use of relatively simple assembly automatons.

In place of a self-release latching of the tripping member on the sliding face of a slip-off latch, as in the described embodiment, it would also be possible to have a self-release latching or locking action on the basis of the toggle lever principle. With respect to the tripping movement, it is appropriately chosen as a function of the construction of the appliance protective switch to be tripped. In place of a preponderantly translatory movement, it would e.g. be possible to have a purely pivoting movement. With respect to the direction of in particular a translatory movement component, a substantial degree of design freedom again exists. The choice of the direction of the translatory part of the tripping movement of the tripping member substantially parallel to the axial direction of the electromagnet winding and substantially at right angles to the initial armature movement in the described embodiment permits a very compact construction of the overall device, whilst simultaneously bringing about a very good leverage utilization.

We claim:

1. An undervoltage tripping device for actuating an appliance protective switch when the line voltage of an AC power line drops below a nominal value, the tripping device comprising:

a rectifier (67) connected to the AC power line for converting AC current to DC current;

a DC electromagnet including a magnetic winding (3) energizeable by DC current from the rectifier and a core (10) which is at least partially surrounded by the magnetic winding;

an armature (20) magnetically coupled with the core and movable between an attracted position and a dropped position, the armature being in the attracted position when the line voltage of the power line is at the nominal value, the armature being spring-loaded to move from the attracted position to the dropped position when the line voltage of the power line drops below the nominal value; and a tripping member (50) connectable to the appliance protective switch and movable between a latched position and a released position for, when connected to the appliance protective switch and in the released position, actuating the appliance protective switch, the tripping member being mechanically coupled with the armature and movable relative to the armature, the armature acting as a ratchet for the tripping member to maintain the tripping member in the latched position when the line voltage of the power line is at the nominal value, the tripping member being spring-loaded from the latched position to the released position to thereby actuate the appliance protective switch when the line voltage of the power line drops below the nominal value, the tripping member moving the armature from the dropped position back to the attracted position when the tripping member is moved from the released position back to the latched position.

2. An undervoltage tripping device according to claim 1 further including a series resistor (69) for reducing the current flowing through the magnetic winding of the DC electromagnet.

3. An undervoltage tripping device according to claim 1 wherein the armature and the core are constructed as flat parts with planar lateral faces and wherein pole faces of the armature and the core are arranged on adjacent lateral faces.

4. An undervoltage tripping device according to claim 3 wherein the armature and the core are stamped parts stamped from a rolled metal sheet and not reworked on the pole faces.

5. An undervoltage tripping device according to claim 3 wherein the core is E-shaped or U-shaped and wherein the overall cross-section of the pole faces is larger than the total cross-section of all the core E or U-legs (11, 12).

6. An undervoltage tripping device according to claim 1 wherein the spring-loading of the armature and the tripping member is jointly brought about by a single tensioned tripping spring (17).

7. An undervoltage tripping device according to claim 5 wherein a smaller portion of the elastic energy stored in the tensioned tripping spring is necessary for moving the tripping member from the latched position to the released position, and a larger portion of the elastic energy is available for its tripping movement.

8. An undervoltage tripping device according to claim 1 wherein the armature is forcibly fed into its attracted position by the tripping member when the tripping member is brought into its latched position under external influence.

9. An undervoltage tripping device according to claim 1 wherein movement of the tripping member from the latched position to the released position is mainly a rotary movement up to release of the latching position and subsequently mainly a translatory movement.

10. An undervoltage tripping device according to claim 9 wherein the tripping member is constructed as a two-armed lever balanced about a pivot having a pivot axis and has an armatureside lever arm (51) and a tripping or restoring lever arm (52) and wherein the pivot of the two-armed lever is displaceably mounted in an elongated guide link (44).

11. An undervoltage tripping device according to claim 10 wherein, with respect to the axial direction of the magnetic winding, the tripping member on the armature side is substantially positioned laterally adjacent thereto and wherein the guide link and consequently the translatory part of the tripping movement of the tripping member is substantially parallel to the axial direction and away from the armature.

12. An undervoltage tripping device according to claim 10 wherein the tripping or restoring lever arm (52) of the tripping member has a sloping surface (58) arranged in oblique-angled manner relative to the longitudinal direction of the guide link (44) for the action of a delivery or feed force (Z) such that a force component is produced in this direction when a feed force substantially acts in this direction, as well as a torque about the pivot axis of the tripping member.

* * * * *